US005592980A

United States Patent [19]

Stern et al.

[11] Patent Number: 5,592,980

[45] Date of Patent: Jan. 14, 1997

[54] TONER CONTAINER

[75] Inventors: Philip A. Stern, Spencerport; Terry R. Elich, Pittsford; Thomas S. Wicks, Penfield, all of N.Y.

[73] Assignee: Eastman Kodak Company, Rochester, N.Y.

[21] Appl. No.: 410,461

[22] Filed: Mar. 24, 1995

[51] Int. Cl.[6] ..... B65B 1/04; B65B 3/00

[52] U.S. Cl. ..... 141/364; 141/383; 141/366; 141/319; 220/350; 222/561; 222/DIG. 1; 399/119

[58] Field of Search ..... 141/351, 352, 141/354, 360–366, 319, 320, 332, 383–386, 379–381; 222/DIG. 1, 185, 325, 561; 355/260; 220/331, 345, 346, 350, 347, 349; 128/200.12, 200.22, 200.23

[56] References Cited

U.S. PATENT DOCUMENTS

| | | | |
|---|---|---|---|
| 1,878,874 | 9/1932 | McBride | 222/561 |
| 3,332,586 | 7/1967 | Amburgey | 222/561 |
| 4,278,190 | 7/1981 | Oory et al. | 222/561 |
| 4,937,628 | 6/1990 | Cipolla et al. | 355/260 |
| 5,089,854 | 2/1992 | Kaieda et al. | 141/364 |
| 5,313,993 | 5/1994 | Corby et al. | 141/364 |

*Primary Examiner*—David J. Walczak
*Assistant Examiner*—Steven O. Douglas
*Attorney, Agent, or Firm*—Leonard W. Treash, Jr.

[57] ABSTRACT

A container for supplying toner includes a containing portion with an opening through which toner is moved into a receiving sump. A cover for the opening is flexible enough to move in an arcuate path from a position coveting the opening to a position of storage alongside a sidewall of the containing portion. The cover is stiff enough to be pushed back to its covering position. The leading edge of the cover in its movement back to its coveting position is made concave to the direction of movement so that it will more easily enter a channel partially defined by a seal around the opening. A protrusion on the cover enters a hole in a cover holding member when the cover is in its coveting position to lock the cover in place when the container is not on a receiving apparatus. The protrusion can be pushed out of the hole, unlocking the cover by an appropriate receiving member.

5 Claims, 7 Drawing Sheets

FIG. 5
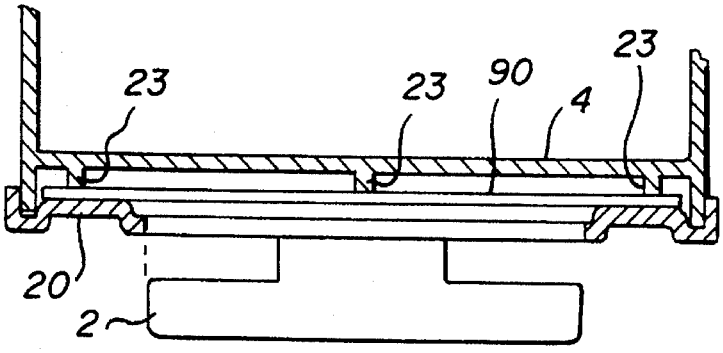
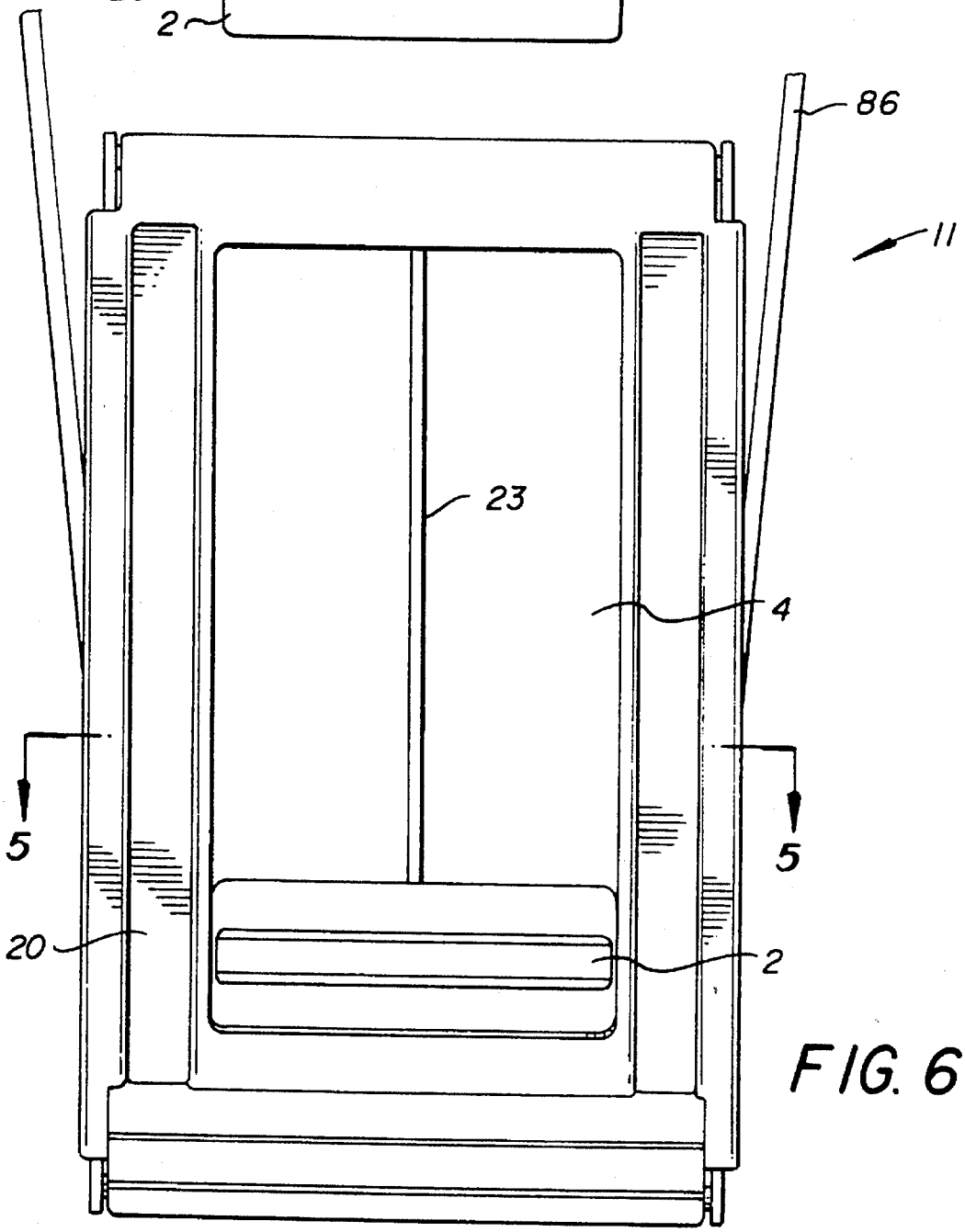
FIG. 6

TONER CONTAINER

BACKGROUND OF THE INVENTION

This invention relates to a container for toner of the type used in copiers and printers. More specifically, it relates to a toner container having a cover which prevents the escape of toner before the toner container is installed in a copier or printer.

U.S. Pat. No. 5,313,993, granted May 24, 1994 to Corby et al, shows a toner container having a containing portion with a base having an opening through which toner falls into a sump in a receiving apparatus. A cover is positioned to move through an arcuate path from a position covering the opening to a position along a sidewall of the containing portion uncovering the opening. A guide means guides the cover in its movement through the arcuate path. The cover is made of a material flexible enough to move through the arcuate path but stiff enough to be pushed back into its covering position before the container is removed. Compliant seals are located in the guide means around the opening to prevent the escape of toner when the cover is in its covering position.

The reference also discloses that the cover be lockable in its closed position when the container is not in the receiving apparatus and that the lock be automatically releasable by the receiving apparatus.

SUMMARY OF THE INVENTION

This invention is an improvement on the container shown in U.S. Pat. No. 5,313,993, which patent is hereby incorporated by reference herein.

Because the opening is rectangular in shape, the seal is also rectangular in shape. It is positioned in the guide for the cover so that it forms with the guide a relatively tight cavity or channel through which the cover moves. Movement of the cover through the channel is relatively easy except for entering a cross or transverse portion of the channel across the path of the cover at the end of the path. We found that if the leading edge of the cover does not mate exactly with this cross portion of the channel, this portion of the channel can resist movement of the leading edge of the cover into it. It especially resists the middle of the leading edge of the cover.

It is an object of the invention to improve the performance of the cover in a toner container similar to that shown in the prior art described above.

This and other objects are accomplished by providing a cover having a leading edge (with respect to movement of the cover to its coveting position) that is concave in shape With respect to a portion of a seal positioned across the path of the covet to facilitate movement of the cover fully into its covering position.

With this shape, the comers of the leading edge enter the transverse portion of the channel first where they are guided by longitudinally oriented portions of the channel. The middle of the leading edge is then drawn or cammed into the channel after the corners.

According to a further preferred embodiment, movement of the cover itself with respect to the seal and the guide is improved if the cover is made out of a low density polyethylene while the seal and, preferably, the guides are made out of a high density polyethylene. A low density polyethylene 1 mil thick provides both the rigidity, and flexibility desired for the cover and parts made with these two materials slide easily when in contact.

It is also an aspect of the toner container disclosed herein to provide an improved lock for the cover, locking the cover in its covering position when the container is out of the receiving apparatus, which lock is releasable by the receiving apparatus.

BRIEF DESCRIPTION OF THE DRAWINGS

FIGS. 4, 5, and 6 are right section, top section and front view, respectively, of portions of an improved toner container with FIG. 5 being sectioned along 5—5 in FIG. 6.

DETAILED DESCRIPTION OF THE INVENTION

Figure 1:
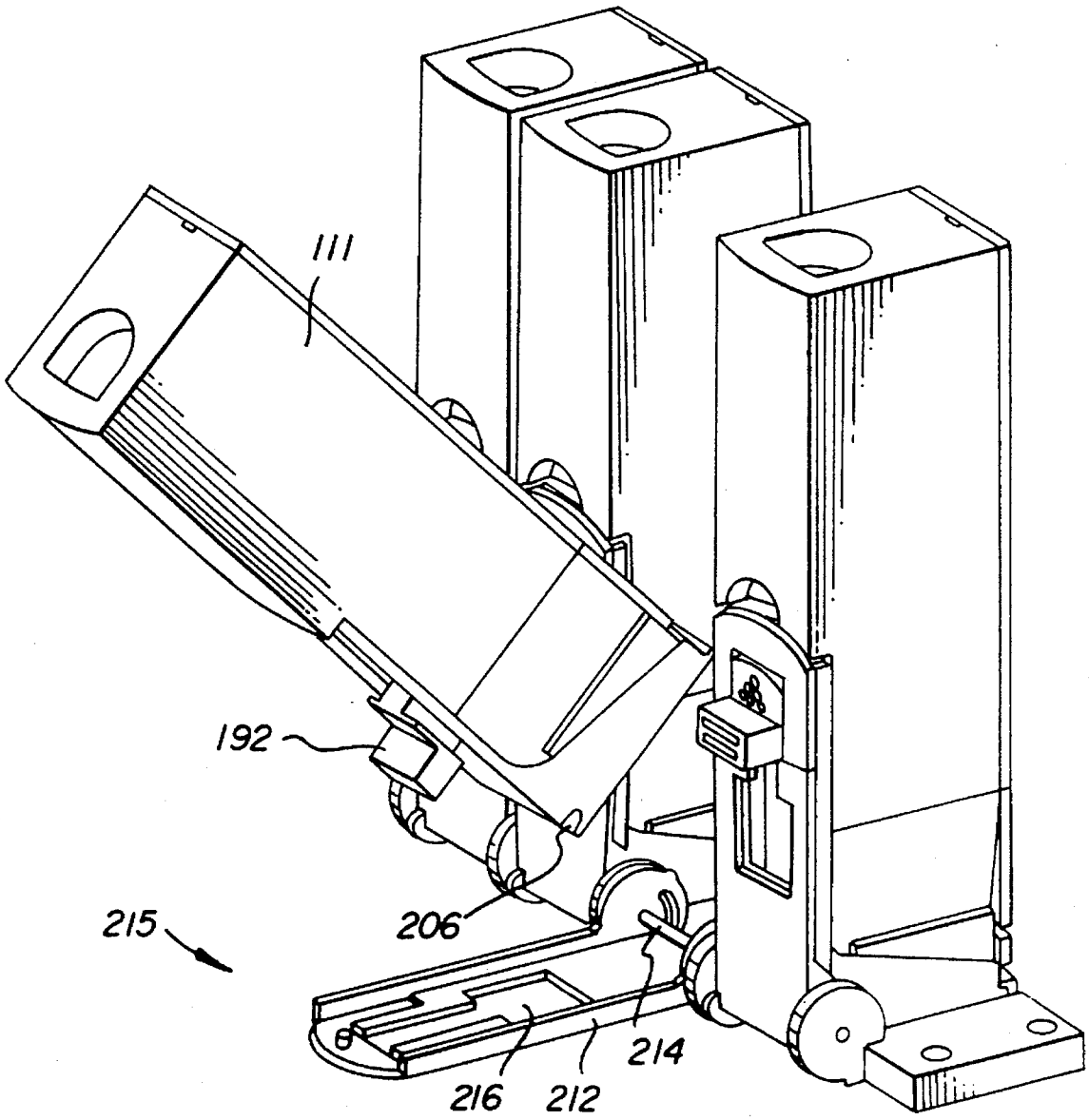
FIG. 1 PRIOR ART
FIGS. 1–3 are perspective, exploded perspective and side sections, respectively, of a prior art toner container and receiving apparatus.
Figure 2:
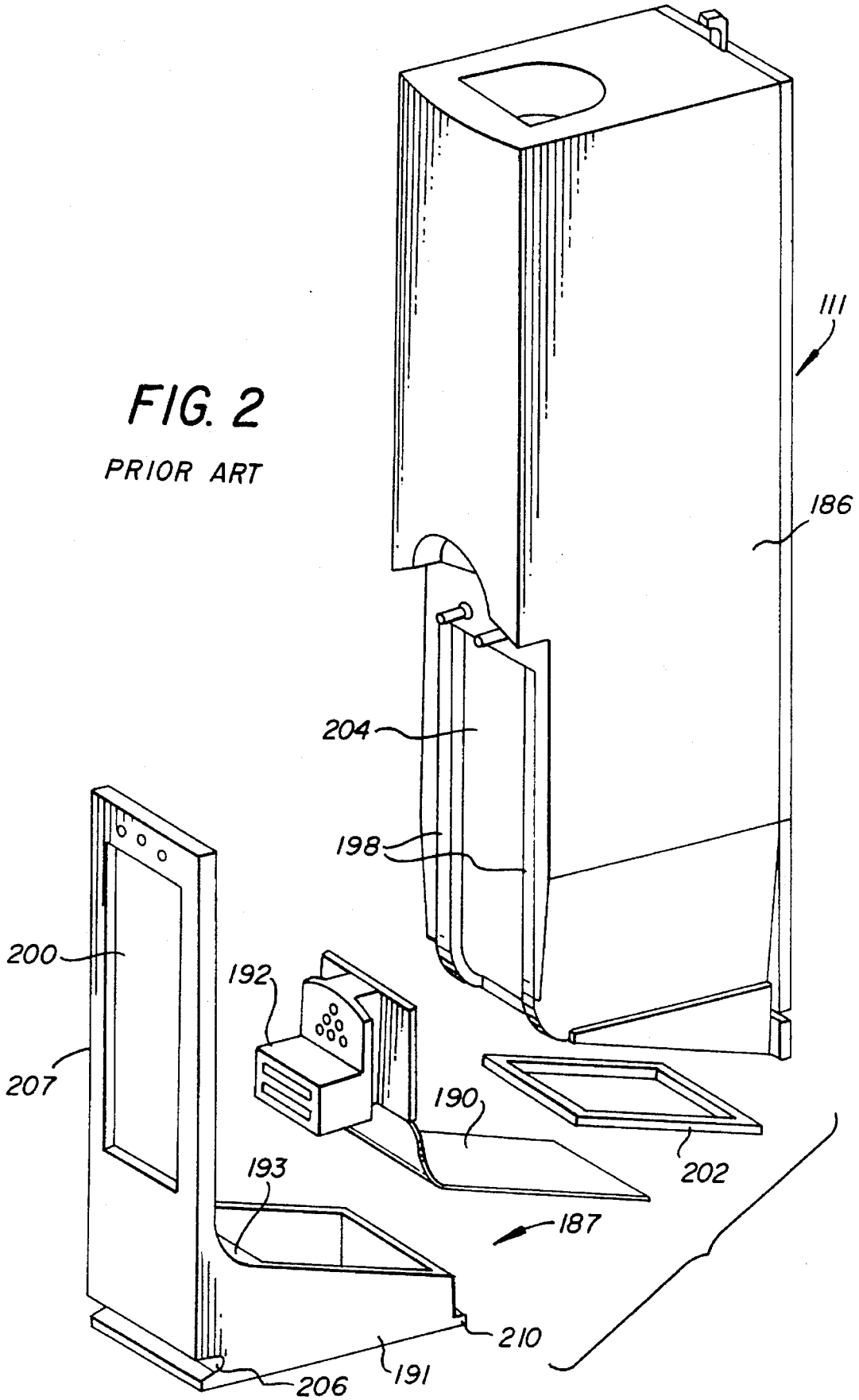
FIG. 2 PRIOR ART
Figure 3:
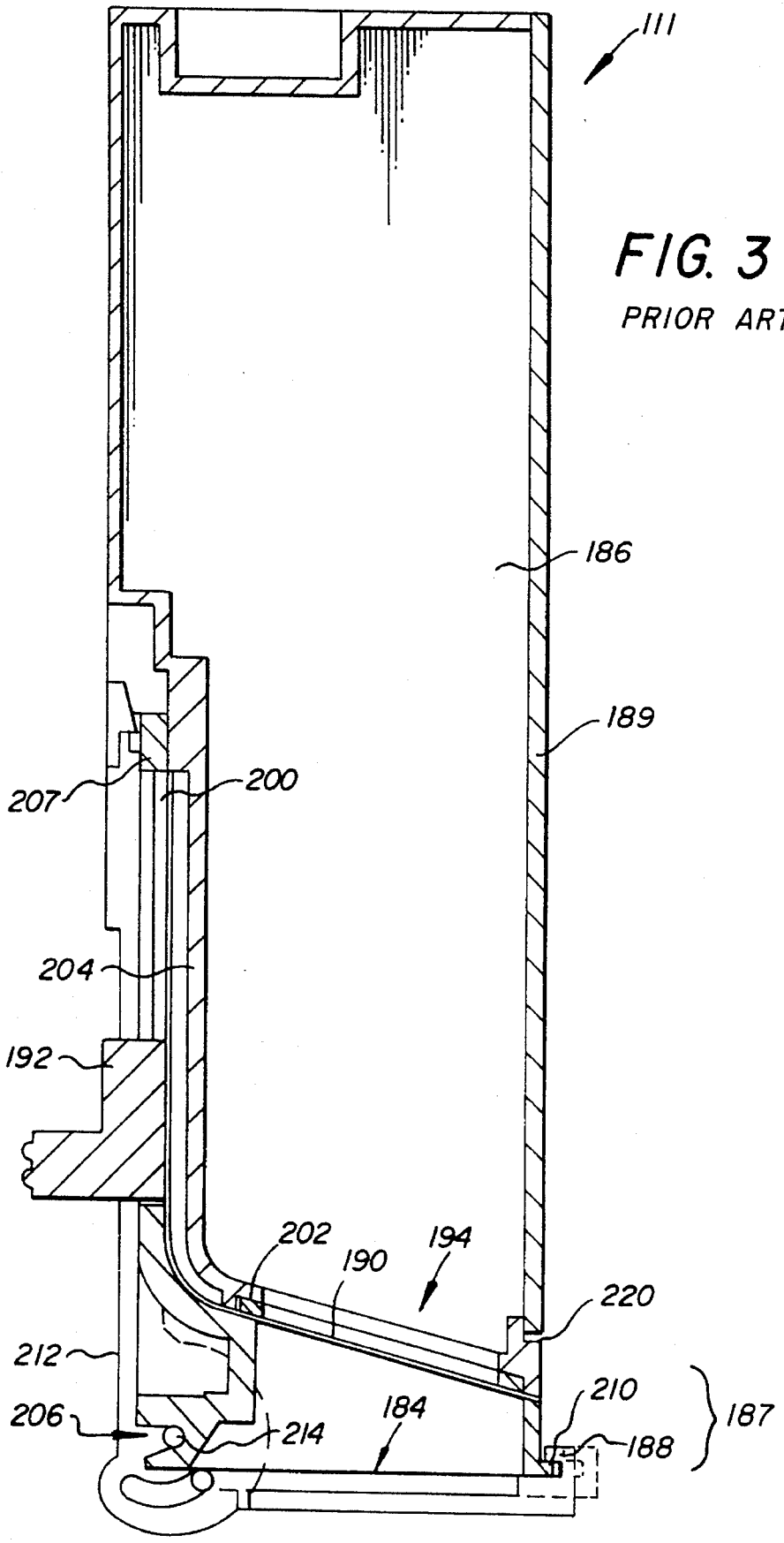
FIG. 3 PRIOR ART

FIGS. 1–3 illustrate a prior art toner container disclosed in U.S. Pat. No. 5,313,993, referred to above, (which toner container is improved upon by a container illustrated in FIGS. 4–9.

FIG. 1 shows a toner container or bottle 111 which is to be positioned over a sump (schematically designated 184 in FIG. 3) and held by a suitable interface or receiving structure 215. The receiving structure 215 includes a lever 212 having an axle 214 around which the lever 212 is rotatable by hand by the person inserting the toner container 111. As shown also in FIGS. 2 and 3, the toner container 111 includes a slot 206 which is fit over the axle 214 in placing the container on the receiving structure 215. AS seen in FIG. 3, rotation of the lever 212 to a vertical position around axle 214 cams a holding detent 188 over a lug 210 on the container So that the container is held to the receiving apparatus primarily through the engagement of slot 206 with axle 214 and the holding detent 188 with lug 210.

Referring to FIGS. 2 and 3, the container 111 includes a containing portion 186 defined by a set of walls, including sidewalls 189 and 204. Container 111 also includes a base 187, a cover 190 and a handle 192. The base and the bottom of the containing portion 186 define an opening 194 through which toner falls into the sump of the receiving structure.

The cover 190 is flexible and is connected to the handle 192 so that it can move through an arcuate path from a position covering the opening 194 to a position along sidewall 204 to allow the toner to be delivered to the sump. When the toner container is empty and to be replaced, the handle 192 is lowered to push the cover back into its covering position, preventing the escape of further toner after the container has been removed.

Referring to FIG. 1, the lever 212 includes an opening 216 which is shaped to allow the lever to move over the handle 192 when the cover 190 is in its covering position. When the handle 192 is raised, it mechanically prevents lowering of the lever and release of the container from the holding mechanism.

U.S. Pat. No. 5,313,993 suggests that a latch prevent the cover from being opened until the lever is in place, which lever would release the latch, to allow opening of the cover only when the container is in position on the receiving structure.

Movement of the cover is guided, in part, by a lower guide surface 193 (FIG. 2) and some upper guide rails 198. The opening 194 is rectangular and is sealed by a rectangular seal 202 secured to a lower wall of the containing portion, which lower wall also defines the top of opening 194. Note that cover 190 moves in a channel or recess formed between lower guide surface 193 and seal 202 as cover 190 moves between its covering and uncovering positions. As seen in FIG. 2, the lower guide surface is defined by a base part 191 which also includes an extension 207 having an opening 200 through which handle 192 extends. As explained in U.S. Pat. No. 5,313,993, the cover 190 is made of a 0.010 inch thick polyester which is flexible enough to move through the arcuate path from a position covering opening 190 to a conveniently stored position oriented more vertically along sidewall 204. It is also stiff enough to be pushable by handle 192 back into position over opening 194 for easy and very secure closing of the container. It is even contemplated that the container could be closed with toner still in it for replacement with a new container, for example, a new container having a different color toner. Toner flows through the opening 194 into the receiving sump generally designated in FIG. 3 as 184.

FIGS. 4–9 describe a toner container which improves upon the structure described in U.S. Pat. No. 5,313,993. Any elements not shown in FIGS. 4–9 should be presumed to be substantially the same as those described in FIGS. 1–3 or adapted from U.S. Pat. No. 5,313,993.

Figure 4:
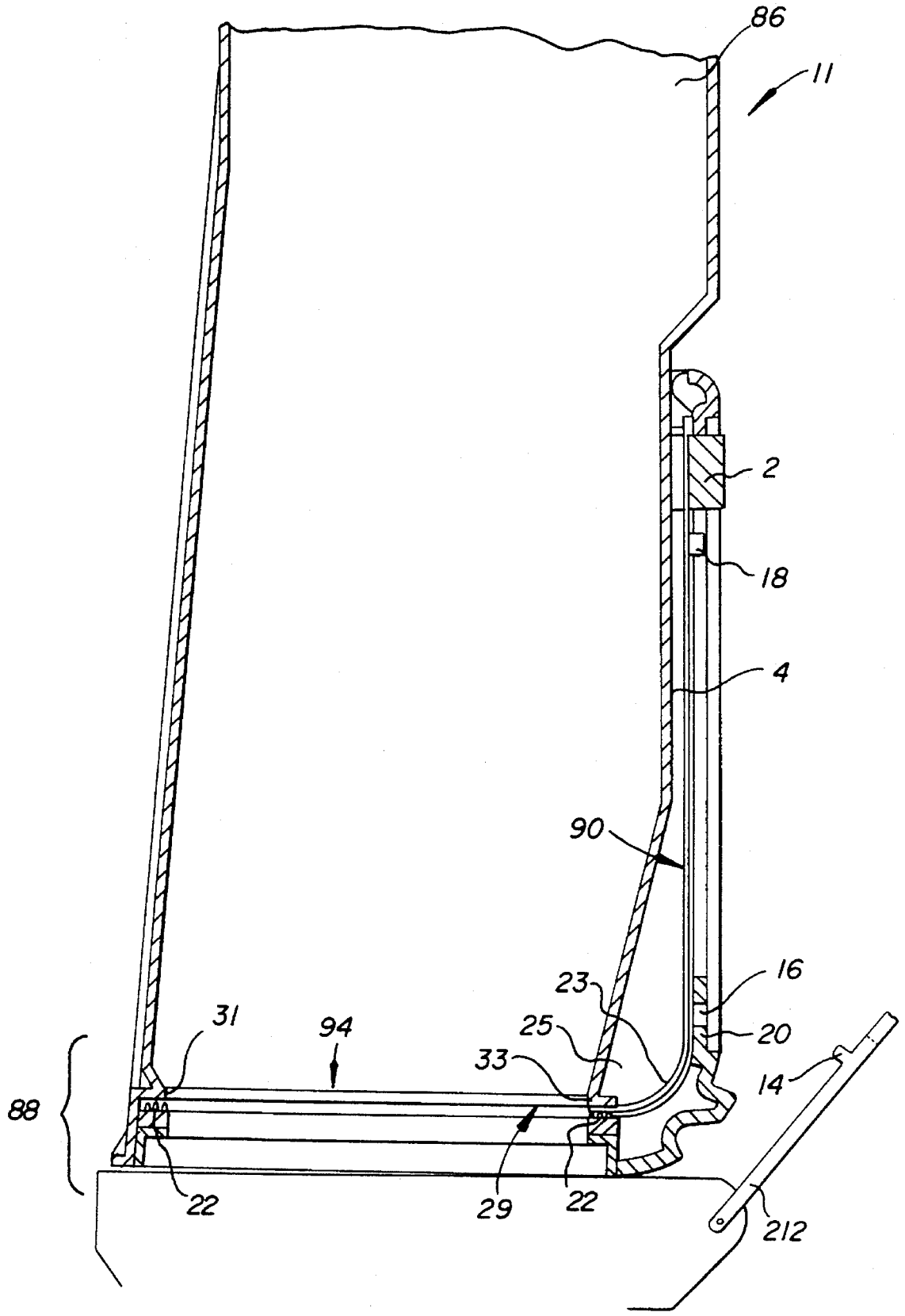
Figure 7:
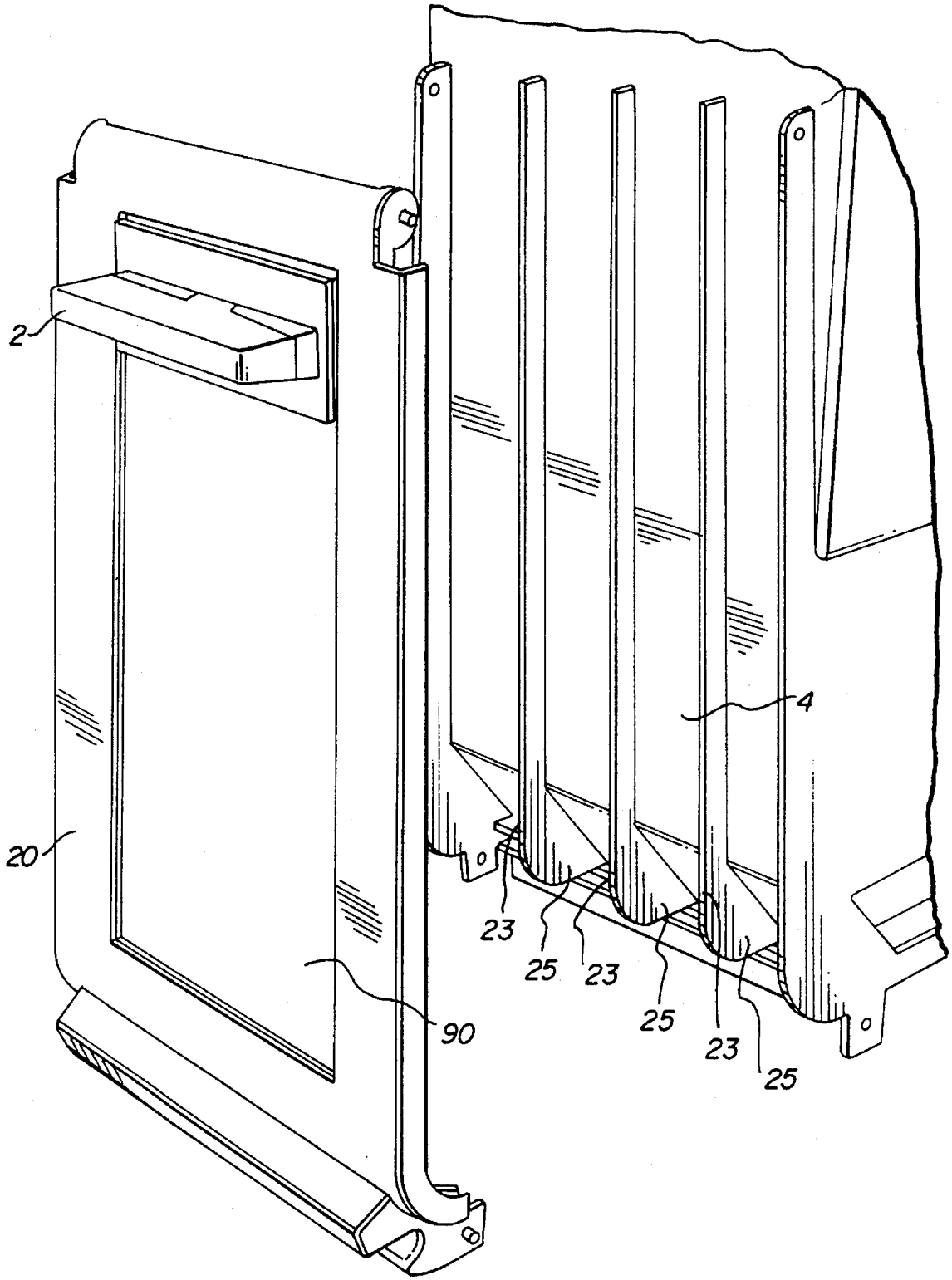
FIG. 7 is an exploded perspective view of a portion of the toner container shown in FIGS. 4–6.

Referring to FIG. 4, a toner container 11 contains a containing portion 86 defining at its bottom an opening 94 through which toner can empty into a sump. A cover 90 is positioned to move through an arcuate path between a position coveting opening 90 and a position uncovering opening 90 (shown in FIG. 4) Where it is located alongside a sidewall 4 in an unprotruding and convenient position. A base 88 of the container 11 includes a portion which sits on a receiving structure. It also includes the bottom of the containing portion 86 which defines the opening 84 as well as surfaces which guide the cover 90 through at least a portion of its path around opening 94. Molded integrally with the cover 90 is a handle 2 which the operator uses to move the cover 90 through its arcuate path.

As shown in FIG. 4, a protrusion 18 on cover 90 is used to lock the cover in its covering position. Although the cover is shown in its uncovering position in FIG. 4, when moved to its covering position, protrusion 18 fits into a hole 16 in a cover holding member 20 to lock the cover in place. The hole 16 extends through cover holding member 20. Protrusion 18 can be released from hole 16 by a finger 14 on a lever 212 in the receiving structure. Lever 212 is rotated to a vertical position as in the prior art shown in FIGS. 1–3 to secure the base of the toner container 11 to the receiving structure. When the lever 212 is in its fully raised, vertical position, finger 14 pushes protrusion 18 out of hole 16, allowing the cover 90 to be moved to its uncovering position by the operator, using handle 2. In FIG. 4 lever 212 is not shown in a totally vertical position for clarity of illustration, despite the fact that cover 90 is shown in its uncovering position. In fact, cover 90 would only be in the uncovering position when lever 212 was fully vertical and releasing finger 14 had entered hole 16. This particular structure is a particularly inexpensive approach providing the security of a cover that is locked in place when the container is not on the apparatus but is readily releasable when in place and the base is locked to the receiving structure. Note that lever 212 cannot be lowered when the cover is moved toward its uncovering position because of openings shown in FIGS. 1–3 in lever 212, which openings are not shown in FIG. 4.

Cover 90 is guided through its arcuate path by a number of guide surfaces. Ribs 25, shown best in FIG. 7, define portions of surfaces 23 which contact the upper or inner surface of cover 90 as it moves through its arcuate path. Complementary surfaces on the inside of cover holding member 20 contact the outside or lower side of cover 90 during this same movement.

In the area around the opening 94, the cover 90 is guided on its upper side by a surface 29 which is an extension of surface 23 and continues to contact the upper side of the cover as it moves across the opening 94. A cross extension 31 of surface 29 receives the leading edge 92 of the cover 90 as cover 90 comes to rest in its fully covering position. A parallel cross extension 33 of surface 29 extends across the opposite side of opening 94. A rectangular seal 22 is positioned to contact the lower side of cover 90. It extends totally around the opening 94 and helps cover 90 and surface 29 seal the opening. Seal 22 has a cross portion 24 facing cross extension 31 of surface 29. Seal 22 is preferably of an injection molded, high density polyethylene. It is formed in the same shape as is seal 202, shown in FIG. 2, and is adhesively bonded on its lower surface to the base 88 of the toner container 11. It can also be molded into base 88. The seal 22 and the surface 29, including cross extensions 31 and 33, combine to define a channel or recess that is tight for cover 90 to seal opening 94 from escape of toner.

Figure 9:
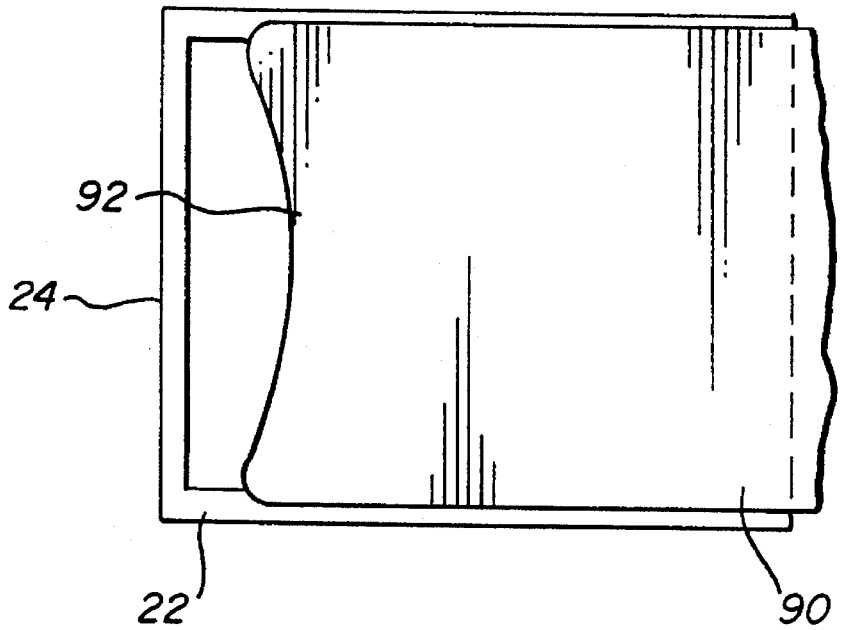
FIGS. 8 and 9 are a left section and a top schematic, respectively, illustrating movement of a cover relative to a seal in the toner container of FIGS. 4–7.
Figure 8:
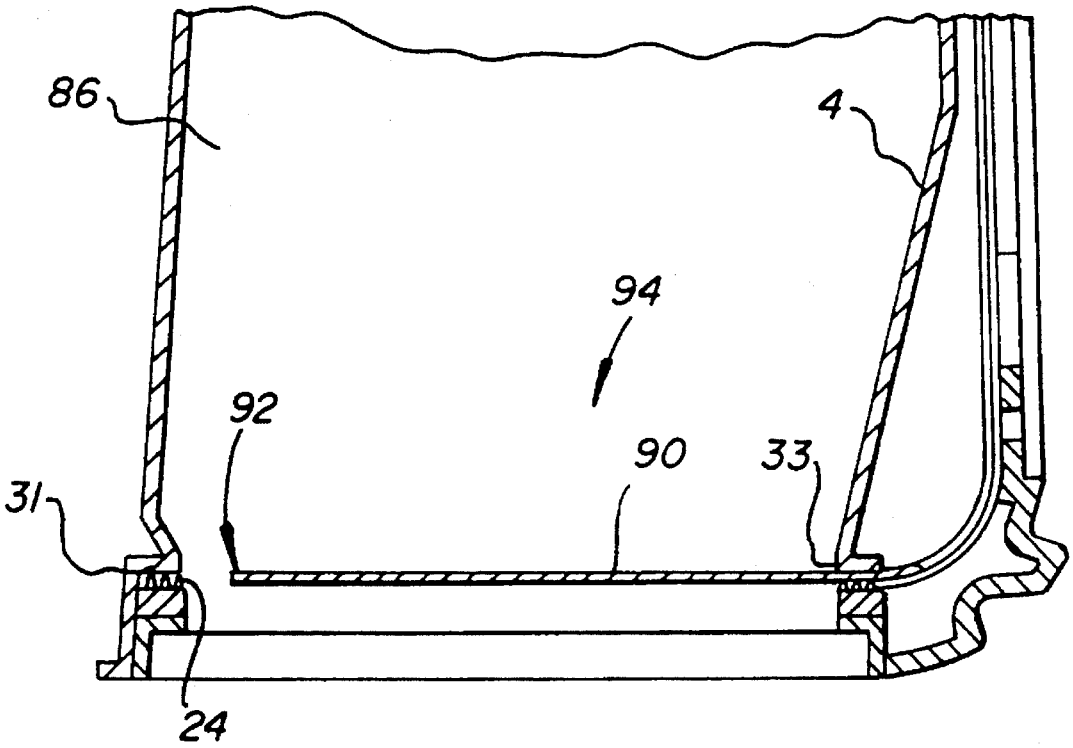

The combination of a high density polyethylene guide surface and seal and a low density polyethylene cover 90 provides relatively easy sliding movement for the cover 90 until the leading edge 92 of cover 90 attempts to enter that portion of the channel formed by cross extension 31 of surface 23 and complementary cross portion 24 of seal 22. If the center of the leading edge 92 has drooped in the middle, it may resist entering that portion of the channel. However, as seen in FIG. 9, the leading edge 92 has been curved, concave to cross portion 24 of seal 22, so that the comers of the leading edge enter that portion of the channel or recess first. Because the corners are already guided by longitudinal, intrack, portions of the channel, they enter with no difficulty and essentially cam the rest of the leading edge into the channel. Although the leading edge is shown with a gradual curve, other concave shapes will provide similar camming movement. For example, a V-shape, concave to the cross portion 24 of the seal would be similarly effective.

The invention has been described in detail with particular reference to a preferred embodiment thereof, but it will be understood that variations and modifications can be effected within the spirit and scope of the invention as described hereinabove and as defined in the appended claims.

We claim:

1. A container for supplying toner to a receiving apparatus, said container comprising:

a containing portion having means defining an opening through which toner can pass, a cover movable through a path between a position covering the opening and a position uncovering the opening, the cover having a leading edge in movement to its covering position, guide means for guiding the cover through said path, said guide means including a transverse portion extending across the path that engages both sides of the cover at its leading edge when the cover is in its covering position, said portion including a seal for sealing the leading edge of the cover when the cover is in its covering position, characterized in that the leading edge of the cover is concave in shape to facilitate moving the leading edge of the cover into said transverse portion of the guide means as the cover moves fully to its covering position.

2. A container according to claim 1 wherein the seal is formed of a high density polyethylene and the cover is formed of a low density polyethylene.

3. A container for supplying toner to a receiving apparatus, said container comprising:

a containing portion having at least one vertically extending sidewall and means defining an opening through which toner may pass under influence of gravity, a cover movable through an arcuate path between a position covering the opening and a position uncovering the opening and generally positioned along the sidewall, the cover having a leading edge in movement to its covering position, guide means for guiding the cover in its movement through its arcuate path, said guide means including a seal and a surface defining with the seal a channel in which the cover moves in movement through its arcuate path, said guide means further defining a portion of the channel which is transverse to the direction of movement of the cover into which the leading edge of the cover enters as it completes its movement to cover the opening, characterized in that the leading edge of the cover is concave in shape in the direction of movement when the cover is moving to its covering position, said concave shape defining corners which enter the transverse portion of the channel first to help guide the rest of the leading edge into said transverse portion.

4. A container according to claim 3 wherein the cover is sufficiently flexible to move through the arcuate path but sufficiently stiff to be pushed back to its covering position within said channel.

5. A container according to claim 3 wherein the seal and surface forming the guide means are formed of high density polyethylene and the cover is formed of low density polyethylene.

* * * * *

UNITED STATES PATENT AND TRADEMARK OFFICE

CERTIFICATE OF CORRECTION

ATENT NO. : 5,592,980

ATED : January 14, 1997

NVENTOR(S) : Philip A. Stern et al

It is certified that errors appear in the above-identified patent and that said Letters Patent hereby corrected as shown below:

ABSTRACT, item [57]

line 4, "coveting" should read --covering--
line 8, "coveting" should read --covering--
line 12, "coveting" should read --covering--

Signed and Sealed this

Fourteenth Day of October, 1997

*Attest:*

BRUCE LEHMAN

*Attesting Officer*

*Commissioner of Patents and Trademarks*